US008608151B2

(12) United States Patent
Chiari et al.

(10) Patent No.: US 8,608,151 B2
(45) Date of Patent: Dec. 17, 2013

(54) LOADING STATION FOR PLATE ELEMENTS AND MACHINE FOR PROCESSING SUCH ELEMENTS

(75) Inventors: Mauro Chiari, Denges (CH); Olivier Gaillard, Suchy (CH); Raymond Lambelet, Vufflens-la-Ville (CH)

(73) Assignee: Bobst Mex SA (CH)

( * ) Notice: Subject to any disclaimer, the term of this patent is extended or adjusted under 35 U.S.C. 154(b) by 0 days.

(21) Appl. No.: 13/256,768

(22) PCT Filed: Mar. 11, 2010

(86) PCT No.: PCT/EP2010/001520

§ 371 (c)(1),
(2), (4) Date: Oct. 14, 2011

(87) PCT Pub. No.: WO2010/105762

PCT Pub. Date: Sep. 23, 2010

(65) Prior Publication Data

US 2012/0038098 A1 Feb. 16, 2012

(30) Foreign Application Priority Data

Mar. 16, 2009 (EP) ..... 09003734

(51) Int. Cl.
*B65H 31/04* (2006.01)

(52) U.S. Cl.
USPC ..... 271/3.05; 271/214

(58) Field of Classification Search
USPC ..... 271/3.01, 3.02, 3.05, 151, 245, 264, 271/275, 201, 214, 215, 217; 414/797.6
See application file for complete search history.

(56) References Cited

U.S. PATENT DOCUMENTS

| | | | | | |
|---|---|---|---|---|---|
| 3,422,969 | A | * | 1/1969 | Miller et al. | 414/788.5 |
| 3,612,511 | A | * | 10/1971 | Godlewski | 271/35 |
| 3,880,059 | A | * | 4/1975 | Brockmuller | 414/789 |
| 3,900,115 | A | * | 8/1975 | Kumagai | 414/773 |
| 4,457,658 | A | | 7/1984 | Meylan | |
| 4,700,941 | A | * | 10/1987 | Shill | 271/151 |
| 4,771,896 | A | | 9/1988 | Newsome | |
| 5,213,319 | A | | 5/1993 | Crowe et al. | |
| 5,242,262 | A | | 9/1993 | Andre et al. | |

(Continued)

FOREIGN PATENT DOCUMENTS

| | | |
|---|---|---|
| CH | 639045 | 10/1983 |
| EP | 0451592 | 10/1991 |

(Continued)

OTHER PUBLICATIONS

International Search Report dated Jun. 28, 2010, issued in corresponding international application No. PCT/EP2010/001520.

*Primary Examiner* — Jeremy R Severson
(74) *Attorney, Agent, or Firm* — Ostrolenk Faber LLP

(57) ABSTRACT

A station for loading plate elements (1, 1*a*), from an initial pile of the elements in a storage device (4) to an infeed station for a machine for processing the elements. An unloading device (7) unloads the elements (1*a*) from the initial pile (3). An intermediate storage device (16), stores the unloaded elements (1) in the form of an intermediate batch (19) and is positioned downstream of the unloading device (7), a conveyor device (18) for conveying the elements (1) from the storage device (16) to the infeed station, and a shingling device (21) for shingling the elements (1) and being positioned downstream of the storage device (16).

6 Claims, 1 Drawing Sheet

(56) References Cited

U.S. PATENT DOCUMENTS

| | | | | |
|---|---|---|---|---|
| 5,326,088 | A * | 7/1994 | Newsome | 271/3.23 |
| 5,575,463 | A * | 11/1996 | Parkander | 270/52.02 |
| 5,913,656 | A * | 6/1999 | Collins | 414/801 |
| 6,595,740 | B1 * | 7/2003 | Drake et al. | 414/796.8 |
| 7,055,816 | B2 * | 6/2006 | Leu | 271/3.01 |
| 7,178,800 | B2 * | 2/2007 | Stauber | 271/189 |
| 2009/0115122 | A1 * | 5/2009 | Roth et al. | 271/165 |

FOREIGN PATENT DOCUMENTS

| | | | | |
|---|---|---|---|---|
| EP | 0729888 | A | 9/1996 | |
| EP | 1528021 | | 5/2005 | |
| JP | 56113634 | A * | 9/1981 | B65H 1/30 |

* cited by examiner

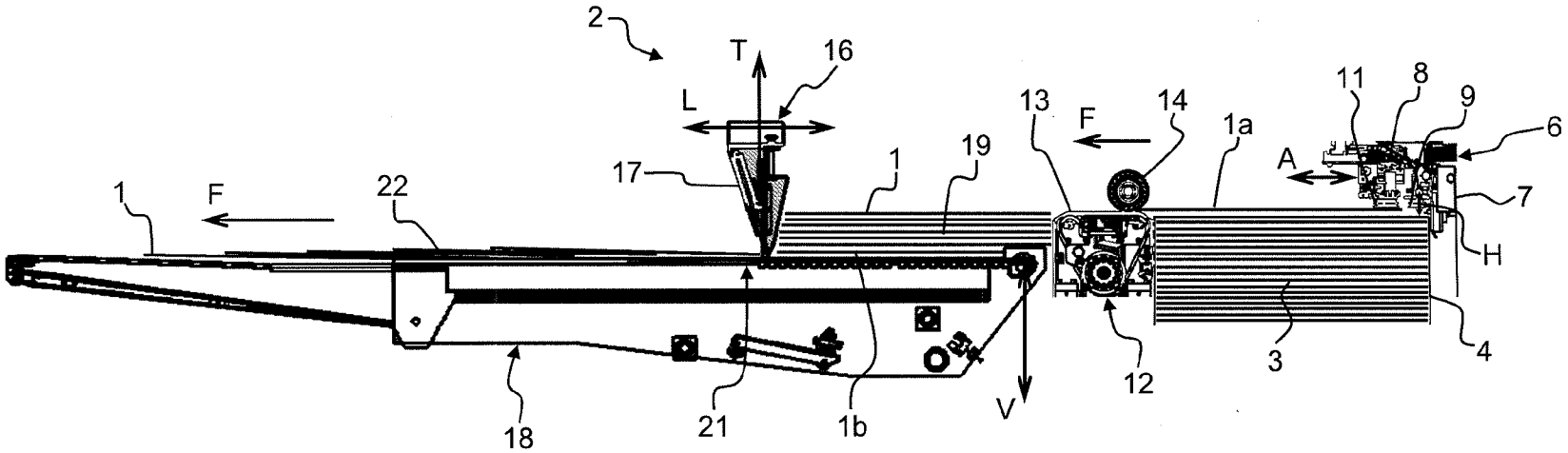
6
7
H
4
9
8
11
A
3
1a
14
12
F
13
V
19
1
1b
16
T
L
21
17
2
18
22
F
1

LOADING STATION FOR PLATE ELEMENTS AND MACHINE FOR PROCESSING SUCH ELEMENTS

CROSS-REFERENCE TO RELATED APPLICATIONS

The present application is a 35 U.S.C. §§371 national phase conversion of PCT/EP2010/001520, filed Mar. 11, 2010, which claims priority of European Application No. 09003734.2, filed Mar. 16, 2009, the contents of which are incorporated by reference herein. The PCT International Application was published in the French language.

BACKGROUND OF THE INVENTION

The present invention relates to a loading station for plate elements. The invention also relates to a machine for processing these elements incorporating such a loading station.

A processing machine, for example a printing machine, is used notably in the packaging industry, for example for making cardboard boxes from plate elements such as sheets of cardboard.

The processing machine usually comprises several stations or workstations, each intended to carry out a specific operation. The plate elements are fed at the inlet of the machine by the feeding station or infeed station or feeder installed upstream. These plate elements are recovered at the outlet of the machine in the delivery station downstream in the form of processed elements, blanks or boxes ready for use.

The feeder automatically introduces the elements into the machine one after another. The feeder first of all comprises a lower vacuum conveyor, which sends the elements into the machine successively one after the other. At this level, the elements are clearly separated and do not overlap in the form of a stream. The elements are then driven and processed one after the other in the machine.

Upstream of the conveyor, a batch of stacked vertical elements is placed in the feeder. The feeder also comprises a vertical gauge. The gauge is used for the frontal alignment of the elements. This gauge is also used for extracting the elements one after another from the bottom of the batch. The gauge can also move vertically, so as to adjust the gap beneath the nose of the gauge, depending on the thickness of the elements.

A first drawback is that the batch applies a considerable pressure force, mainly on the element at the bottom of the batch placed on the conveyor. This pressure is all the greater if the cardboard has a high grammage and the batch is high. This pressure tends to squash these bottom elements that follow one another and to apply a stress, disrupting the conveying of the element by the feeder, reducing the quality of the infeed and consequently the sending of the elements into the machine. In certain cases, the register of the fed elements is lost. In other cases, the feeder feeds in two elements at the same time instead of just one, which is undesirable.

Such a pressure also increases the friction between the element at the bottom of the pile and the element immediately above with which it is in contact, when the bottom element is sent. Since the surfaces may be preprinted or coated with a layer, for example of white color or of other colors, they will be damaged by marks.

In order to feed a machine, an operator continually places small batches of stacked elements in the infeed station. The operator picks up and carries these batches by hand. This makes the work of the operator particularly tiresome, for example when processing corrugated cardboard sheets of large dimensions. Moreover, such manual loading limits capacity in terms of processing speeds.

DESCRIPTION OF THE PRIOR ART

To ensure a rapid rate for the processing machine, a loading station is most frequently incorporated into the machine, upstream of the infeed station. The loading station comprises a loader for loading a pile of plate elements.

Documents CH-639,045 and EP-0,451,592 describe a method and a loader for forming batches from the top of a pile of elements. The last upper elements of the pile, intended to form a batch, are separated from this same pile with the aid of a separator engaged with the edge of the elements of the batch. A pusher pushes away the top of the pile and therefore the batch, toward and onto a conveyor. The successive batches are conveyed, then shingled in the direction of the infeed station of the machine.

However, if the elements are thin sheets of cardboard, they are difficult to grasp and lift, the fork of the separator not being able to be inserted precisely under a single sheet. Moreover, if the elements are sheets of corrugated cardboard with microcorrugations, the rear edge of one of the sheets will be damaged by the fork. Moreover, the pusher crushes the front and rear edges of the sheets. As another drawback, the lower face of the lower sheet of each batch is marked on passing over a flap positioned between the retaining wall of the pile and the conveyor. Finally, the stream has to be restarted systematically at each new batch at the shingling. The stream is always interrupted, which interferes with the quality of feed.

From document EP-1,528,021, a machine for processing plate elements incorporating a feed table and a loading station is known. The station comprises a device for gripping the elements that are present in a pile placed in a storage. The feed table comprises a positioning device in the form of a front stop and a device for conveying the elements in a stream against the stop.

However, in the event of fast rates, the storage will empty very quickly and will require immediate restocking. The interval between a transition from a first pile and the next pile will generate discontinuous stocking with elements. Nonstop operation is not possible. Moreover, the configuration of the stream device that the front edge of each laminated corrugated cardboard element is damaged. Specifically, the front edge of the lower laminated sheet protrudes relative to the corrugations and the upper sheet. This lower sheet continually rubs on the feed table. The passage of such a cardboard element device that the lower sheet is damaged at its front edge and/or is bent down or up against the front edge of the cardboard.

SUMMARY OF THE INVENTION

A main objective of the present invention is to perfect a loading station for a machine intended to process plate elements. A second objective is to produce a loading station, operating at high rates and making it possible to prevent any damage to the elements, irrespective of their profiles, their thicknesses, their stiffnesses or their materials, and thus to pass in particular thin and low-grammage cardboards. A third objective is to succeed in loading and in sending laminated board, without marking it and without damaging the skirt. A fourth objective is to make the stream of elements continuous and to obtain a constant loading of the infeed station. Yet another objective is to fit a machine with a loading station generating an excellent inflow of elements, allowing the subsequent stations to pick up the elements properly aligned and to bring them into the machine in order to process them effectively.

According to one aspect of the present invention, a station for loading plate elements, from an initial pile of elements placed in a storage to an infeed station for a machine for processing the elements, comprises:

- an unloading device, for unloading the elements from the initial pile,
- an intermediate storage device, for storing the unloaded elements in the form of an intermediate batch and positioned downstream of the unloading device,
- a conveyor device, conveying the elements from the storage device to the infeed station, and
- a shingling device, for shingling the elements and positioned downstream of the storage device.

Throughout the description, the plate or sheet element is defined as a nonexhaustive example, as being made of a material such as paper, flat cardboard, corrugated cardboard, laminated corrugated cardboard, flexible plastic, for example polyethylene (PE), polyethylene terephthalate (PET), biaxially oriented polypropylene (BOPP), or other polymers, or yet other materials.

The processing machine is defined, as a nonexhaustive example, as being a platen diecutting machine, a printing machine, with at least one printing unit, for example a flexography, photogravure, offset or an embossing unit, or a creasing unit, or a hot-foil stamping unit, a digital or ink-jet printing machine, a folding-gluing machine or yet others.

The longitudinal direction is defined as making reference to the direction of movement of the element in the machine, along its median longitudinal axis. The upstream and downstream directions are defined as making reference to the direction of movement of the element, along the longitudinal direction in the loading station, in the infeed station and in the whole of the processing machine.

In other words, with the intermediate storage device, the stream is formed continuously, even if stocking of the storage device is temporarily interrupted, for example when a new pile is loaded. With this storage device, the stream is obtained with an even gap between the elements.

With this storage device associated with the conveyor device and the shingling device, the pitch of the stream remains constant, i.e. with no irregularities in the overlap. There is no longer any critical phase of restarting the stream.

According to another aspect of the invention, a processing machine for plate elements is characterized in that it comprises a loading station having one or more technical characteristics described below and claimed.

BRIEF DESCRIPTION OF THE DRAWINGS

The invention will be clearly understood and its various advantages and various features will better emerge from the following description of the non limiting example of embodiment, with reference to the appended schematic drawing FIG. 1, which represents a synoptic side view of a loading station according to the invention.

DETAILED DESCRIPTION OF THE PREFERRED EMBODIMENTS

A machine (not shown) for processing a plate element, for example a flexography printing machine, comprises various printing stations. The plate elements, that is to say the sheets of cardboard to be processed (1), for example by printing them, are picked up and conveyed through the printing machine.

As illustrated in the FIGURE, a loading station (2) is mounted upstream of the printing machine, upstream of its infeed station. The median longitudinal axis of the station (2) is aligned with the median longitudinal axis of the machine.

The sheets (1) arrive in the loading station (2) in an initial main vertical pile (3) placed in a main storage (4) positioned upstream. The sheets (1) leave downstream the station (2). The direction of travel or of running (arrows F in the FIGURE), also called the conveyance path or cardboard passage direction, for the sheets (1) in the longitudinal direction indicates the upstream direction and the downstream direction.

The storage (4) and therefore the station (2) may comprise a pile loader (not visible) for the pile (3) of sheets (1), in the form of a mechanism for elevating the pile. The loader is a pile-lifter, which comprises a lifting platform, substantially horizontal, supporting the pile (3) of sheets (1). The lifting platform can be driven vertically by the elevator mechanism. The elevator mechanism has an electric-motor device, vertically raising or lowering the lifting platform. The motor also makes it possible to ascertain and ensure the accurate positioning of the platform. Thanks to the elevator mechanism, a new pile of sheets (1) is reloaded onto the platform to feed the station (2).

The storage (4) with its pile loader and therefore the station (2) may comprise a pile-top sensor. The pile-top sensor may be connected to an input of a computer. The computer may act on the elevator mechanism to keep the successive upper sheets (1*a*) at a constant level after each leaving of an upper sheet (1*a*). The computer is programmed so that the signal appearing at its output is characteristic of the difference between the measured level of the top of the pile (3) and a setting calculated on the basis of the thickness of the stacked exposures and the frequency of leaving of the sheets. Such a loader is for example substantially similar to that described in document EP-1,170,228.

The station (2) then comprises an arrangement (6) for automatic infeed of the sheets (1) into the station (2), which is positioned above and following the storage (4). The infeed arrangement (6) has unloading device (7).

In a first embodiment, the unloading device (7) comprises a sheet-by-sheet gripper for the successive upper sheets (1*a*) that are on the top of the pile (3). This infeed arrangement (6) feeds the sheets sequentially into the rest of the station (2).

The upper sheet (1*a*) is taken from the pile (3) of sheets (1). Because the successive upper sheets (1*a*) are kept at a constant horizontal level thanks to the pile loader, the unloading device (7) work at a substantially horizontal constant height. The detection by the pile-top sensor makes it possible to check that the upper sheet (1*a*) of the pile (3) is always at a predetermined level so that it can be picked by the unloading device (7).

For this first embodiment, the unloading device (7) may have a suction member (8), with one or more vacuum suction cups (9 and 11). The suction cups (9 and 11) are connected to a vacuum pump or vacuum generator (not shown), generating the vacuum necessary to pick up the upper sheets (1*a*). The position and number of the suction cups (9 and 11) can be adjusted by the operator according to the dimension and type of sheet (1).

Upstream suction cups (9) are driven by a mechanism and make a reciprocating up-and-down movement (arrow H). In another alternative embodiment, the suction cups (9 and 11) have a pneumatic travel. The suction cups (9 and 11) can also optionally be associated with a jack. In the embodied case, the whole infeed arrangement (6) can pivot upstream downwardly or upwardly. This movement (H) is useful in the case of warp of the sheets, their rear edge being able to be at a lower level than that of their front edge.

By their movement (H), these upstream suction cups (9) pick up, separate the upper sheet (1*a*) from the pile (3), then return to fetch the next upper sheet which appears at the top of the pile (3). This movement is associated with an activation and a deactivation of the suction of these upstream suction cups (9).

Downstream suction cups (11) are driven by a mechanism and make an alternating movement from upstream to downstream and vice versa (arrow A). By their movement (A), these downstream suction cups (11) pick up, convey the upper sheet (1*a*) from its level obtained by virtue of the upstream suction cups (9), then return to fetch the next upper sheet (1*a*) that is present by being brought by the upstream suction cups (9). When the downstream suction cups (11) pick up the upper sheet (1*a*), the suction of the upstream suction cups (9) is deactivated.

To obtain a movement of the downstream suction cups (11), the unloading device (7) may also have a crank connecting rod arrangement. The crank connecting rod arrangement is able to move the suction member (8) on a slide. The crank connecting rod arrangement causes a horizontal back-and-forth movement, so as to be able to pick up the successive sheets (1*a*) from the top of the pile (3) and then to be able to release these same successive sheets (1*a*). When the downstream suction cups (11) pick up the upper sheet (1*a*), the suction member (8) is in its furthest upstream position.

The station (2) may comprise device (12) for transferring the sheets, which are positioned downstream of the infeed arrangement (6). This transfer device (12) is associated with the unloading device (7) of the infeed arrangement (6). The sheets are sent sequentially by the unloading device (7) to the transfer device (12). When the transfer device (12) pick up the upper sheet (1*a*), the suction of the downstream suction cups (11) is deactivated. The speed is synchronized between the pick-up of the sheets thanks to the unloading device (7) and the transfer device (12).

The transfer device (12) feeds the sheets sequentially into the rest of the station (2). The sheets (1) are separated from one another and do not overlap one another, in other words, they do not form a stream. To do this, the transfer device (12) include an endless-belt vacuum conveyor (13). The vacuum conveyor (13) picks up the sheet by its front edge. An optional brush (14) may be mounted while being able to be retracted.

According to the invention, the station (2) comprises intermediate storage device (16) for the sheets (1), which are positioned downstream of the transfer device (12). Advantageously, these storage device (16) may have a front-positioning member for the sheets, for example in the form of a front gauge (17).

The station (2) comprises conveyance device (18) for the sheets (1) toward the infeed station, which are positioned downstream of the storage device (16) and of the gauge (17). The conveyance device (18) have a downstream belt conveyor and a vacuum belt under the conveyor at the location of the gauge (17) upstream.

If the speed of the transfer device (12) is uniform, the sheets (1) butt hard against the gauge (17). The sheets (1) may bounce back, especially when they are of corrugated cardboard or compact cardboard of a certain thickness.

In the case of other types of cardboard, such as laminated or low grammage material, it is possible to have a problem of marking of the sheets by the gauge (17). Pressing a sheet against the gauge (17) causes the formation of a more or less damaged zone that can be seen on the corresponding edge because of the flexibility of the lower laminated sheet. This damaged zone can then be found in the print. Reading the register marks may also be difficult or even impossible if the latter are damaged. This damaged zone causes jams of sheets in the machine.

Bounce like embedding distort the longitudinal positioning of the sheets (1). The reference frame corresponding to the longitudinal position is lost or is very imprecise. Specifically, in this case, the sheets are no longer in a correctly aligned position in an intermediate batch (19) clearly delimited by the gauge (17). The consequences of this is that the sheets arriving in the infeed station have lost their register. These sheets (1) will not be aligned and their printing that takes place subsequently in the machine will be offset relative to what was desired at the outset.

To remedy these defects and in a particularly attractive embodiment, the transfer device (12) can have a speed profile in order to accelerate and then immediately decelerate the sheets. The first advantage of the acceleration is that the sheets (1*a*) leave the infeed arrangement (6) by being discharged as quickly as possible. With this acceleration of the sheets (1*a*), the unloading device (7) have the time to carry out their back-and-forth movement to bring the next upper sheet (1*a*).

The second advantage of this is that it makes it possible to significantly reduce the speed of the sheets (1) arriving against the gauge (17), while ensuring a regular rate irrespective of the chosen speed profile, as a function of the rate of the machine and of the mechanical characteristics of the sheets to be processed. Such transfer device (12) are for example substantially similar to those described in document EP-1,528,021.

In a second embodiment (not shown), the unloading device (7) may comprise a pusher member, simultaneously pushing several sheets (1) from the pile (3). The pusher member therefore forms initial batches of sheets (1). The successive upper sheets (1*a*) are kept at a constant horizontal level thanks to the pile loader, and thus the pusher member forms initial batches having a constant number of sheets (1). This pusher member feeds the sheets in initial batches directly into the intermediate storage device (16) against the gauge (17).

The storage device (16) may advantageously incorporate both the positioning member, i.e. the gauge (17), and the conveyance device (18), in order to be able to obtain a blocking and an intermediate batching (19) of the sheets (1). The longitudinal position of the gauge (17) can be adjusted (arrow L) as a function of the dimensions of the sheets (1).

The storage device (16) is obtained by a difference of level between the transfer device (12) and the conveyance device (18). In the first embodiment, the intermediate batch (19) is created gradually as the sheets (1) arrive and are blocked by the gauge (17). In the second embodiment, the intermediate batch (19) is created by the arrival of the successive initial batches. The storage device (16) may very preferably have an arrangement (not shown) to be able to vary (arrow V) the intermediate storage capacity for the sheets (1).

Favorably, the arrangement may be able to vary (V) the height of the conveyance device (18) relative to the transfer device (12). The conveyance device (18) can be positioned at a height lower than that of the transfer device (12). This difference in height makes it possible to obtain a second intermediate storage with variable volume or capacity. The intermediate batch (19) obtained is a function of the thickness of the sheets (1) which are temporarily stored therein, of the time for changing the pile (3) and of the rate of the processing machine downstream. Over-rating of the infeed arrangement (6) and of the transfer device (12), making it possible to fill the intermediate storage, is determined as a function of the rate of the processing machine downstream.

According to the invention, the station (2) also comprises shingling device (21), positioned downstream of the storage device (16). The shingling device (21) may favorably incorporate both the positioning member, i.e. the gauge (17), and the conveyance device (18), so as to be able to obtain a progressive leaving and a conveyance of the sheets, in the form of a stream (22).

Thanks to a gap left at the bottom of the gauge (17), the lower sheets (1*b*) are withdrawn one by one from the bottom of the intermediate batch (19) thanks to the conveyance device (18). The gap beneath the gauge (17) is adjustable (arrow T) as a function of the thickness of the sheets (1) and of the desired pitch for the stream (22). The pitch is also adjusted by the speed of the conveyance device (18).

The present invention is not limited to the embodiments described and illustrated. Many modifications may be made, without, for all that, departing from the context defined by the scope of the set of claims.

The invention claimed is:

1. A station for loading plate elements from an initial pile of elements in a storage device to an infeed station for a machine for processing the elements, the station comprising:

an unloading device configured to unload the elements from the initial pile;

an intermediate storage device positioned downstream of the unloading device and configured to receive the unloaded elements from the unloading device and to store the unloaded elements in an intermediate batch;

a transfer device configured to transfer the elements from the unloading device to the intermediate storage device;

a conveyor positioned at a height lower than the height of the transfer device and conveying the elements from the intermediate storage device to the infeed station; and a shingling device positioned downstream of the intermediate storage device and configured to shingle the elements;

wherein the intermediate storage device includes an arrangement configured to vary a storage capacity for the elements by varying a height of the conveyor, such that the height of the conveyor is changed relative to the transfer device.

2. The station according to claim 1, wherein the intermediate storage device comprises a front-positioning member for the elements positioned for blocking the elements and comprises an intermediate batching of the elements.

3. The station according to claim 1, wherein the intermediate storage device comprises the conveyor and a front-positioning member.

4. The station according to claim 2, wherein the shingling device comprises the front positioning member and the conveyor, and is configured so as to obtain a leaving and a conveyance of the elements in the form of a stream to the infeed station.

5. The station according to claim 1, wherein the transfer device has a speed profile to accelerate and then decelerate the elements.

6. A processing machine for plate elements comprising:

an infeed station, and a loading station according to claim 1, and positioned downstream of the infeed station.

* * * * *